US005402659A

United States Patent [19]

Turner et al.

[11] Patent Number: 5,402,659

[45] Date of Patent: Apr. 4, 1995

[54] APPARATUS FOR DRIVING A LIFTER REEL IN A FABRIC WET PROCESSING MACHINE

[75] Inventors: James K. Turner, Stanley; J. Alan Morgan, Charlotte, both of N.C.

[73] Assignee: Gaston County Dyeing Machine Company, Stanley, N.C.

[21] Appl. No.: 217,615

[22] Filed: Mar. 25, 1994

[51] Int. Cl.[6] ..... D06B 3/28

[52] U.S. Cl. ..... 68/178

[58] Field of Search ..... 68/177, 178; 226/168, 226/178, 188, 190

[56] References Cited

U.S. PATENT DOCUMENTS 3,685,325 8/1972 Carpenter ..... 68/177

FOREIGN PATENT DOCUMENTS 2315564 1/1977 France ..... 68/177
2910485 9/1980 Germany ..... 68/177
6431 2/1973 Japan ..... 68/177

*Primary Examiner*—Philip R. Coe
*Attorney, Agent, or Firm*—Shefte, Pinckney & Sawyer

[57] ABSTRACT

An apparatus for driving a lifter reel in a machine for wet processing of fabric in endless rope form having a jet for directing a flow of liquid to the fabric rope to cause circulation thereof is disclosed and contains a rotatable lifter reel upstream of the jet and over which the fabric rope travels to the jet. The apparatus includes a baffle wheel affixed coaxially to one end of the lifter reel out of the path of the fabric traveling over the lifter reel. The wheel has radially extending baffles against which a liquid flow nozzle directs a flow of liquid in a direction to drive the lifter reel in the direction of rope travel to the jet. The liquid flow nozzle is adjustable radially with respect to the baffle wheel to vary the driven rate of rotation of the lifter reel. The nozzle is commonly connected with the jet to a source of liquid under pressure for use of liquid from the same source by the jet and the nozzle. A reverse nozzle may also be included which is positioned to direct a flow of fluid against the baffles in a direction opposite the rope lifting direction for alternatively causing reverse rotation of the lifter reel.

6 Claims, 5 Drawing Sheets

APPARATUS FOR DRIVING A LIFTER REEL IN A FABRIC WET PROCESSING MACHINE

BACKGROUND OF THE INVENTION

This invention relates to an apparatus for driving a lifter reel in a fabric wet processing machine and, more particularly, to such an apparatus for use in a machine having a jet for circulating the fabric.

Textile web materials in rope form are conventionally processed by apparatus and methods wherein a length of material with its ends sewn together to form the fabric into an endless loop is circulated within a cylindrical vessel while being subjected to treatment liquid, such as a dye liquor. The vessel typically contains a treatment chamber containing a bath of treatment liquor through which the textile rope passes in a compact plaited plug form. Some modern jet dyeing and finishing machines apply the treatment liquid primarily using the jet nozzle, resulting in little or no submerging of the rope plug in any liquid in the treatment chamber. In these machines, a rope circulating system progressively withdraws the rope from the leading end of the plug and returns it to the trailing end of the plug under the influence of the processing liquid being applied and circulated by a jet assembly through which the rope passes during circulation.

As each section of wet processing machine may have a different length of textile web for treatment at any one time, individual electric motors have been provided to drive the lifter reels at different rates in order to cause each of the sections to have the same cycle time. Thus, during the loading of the textile web material, the idling of the lifter reel may be adjusted to determine the load cycle. The individual motors typically cause the lifter reel in the section carrying the longest rope to run at maximum speed and allow the lifter reel treating the shortest rope to run at the slowest speed so that the cycle times are equal.

One problem with the machines described above is the cost of providing electric motors to drive multiple lifter reels within the machines in an individual fashion. One attempt at overcoming this problem can be seen in U.S. Pat. No. 3,685,325 to Carpenter. The Carpenter patent discloses the driving of a lifter reel in a textile wet processing apparatus by fluid power created by impingement on the lifter reel of a pressurized stream of dyeing liquor. While Carpenter may remove the need for individual electric motors, the apparatus disclosed therein still presents problems with respect to the ability to appropriately control the speed of the lifter reel.

SUMMARY OF THE INVENTION

It is therefore an object of the present invention to encourage uniform treatment of the length of textile web material in rope form by a treatment liquid.

It is another object of the present invention to reduce the cost of apparatus for processing lengths of textile web materials.

It is yet another object of the present invention to remove the need for individual electric motors to drive multiple lifter reels individually in apparatus for processing of lengths of textile web material.

These and other objects of the present invention are provided by an apparatus for driving a lifter reel in a machine for wet processing of fabric in endless rope form having a jet for directing a flow of liquid to the fabric rope to cause circulation thereof within the machine, a rotatable lifter reel upstream of the jet and over which the fabric rope travels to the jet. The apparatus comprises a turbine wheel affixed coaxially to one end of the lifter reel out of the path of the fabric traveling over the lifter reel. The turbine has radially extending baffles.

A liquid flow nozzle for directing a flow of liquid onto the baffles in a direction to drive the lifter reel in the direction of rope travel to the jet is included. The liquid flow nozzle is adjustable to vary the direction of the flow of liquid therefrom in relation to the baffles to thereby vary the driven rate of rotation of the lifter reel.

The turbine wheel may have an open side at which the baffles are exposed, and the liquid flow nozzle may include a nozzle for directing fluid at a lateral inclination to the exposed baffles and may be adjustable radially with respect to the lifter reel to vary the radial location of the impact of liquid from the nozzle onto the baffles and thereby vary the driven rate of rotation of the lifter reel and resulting rate of travel of the rope.

The nozzle is commonly connected with the jet to a source of liquid under pressure for use of liquid from the same source by the jet and the nozzle, with adjustment of the nozzle permitting drive of the lifter reel to feed the rope to the jet at a rate compatible with the drive of the rope by the jet.

A reverse nozzle may also be included which is positioned to direct a flow of fluid against the baffles in a direction opposite the rope lifting direction for selectively causing reverse rotation of the lifter reel. The reverse nozzle may have a nozzle disposed radially outwardly of the baffles and at a reverse inclination with respect to the direction of rope travel to the jet for selectively directing liquid to the baffles to cause reverse rotation of the lifter reel. The nozzle means and the reverse nozzle may be commonly connected to a Common source of liquid under pressure.

DESCRIPTION OF THE PREFERRED EMBODIMENT

Figure 1:
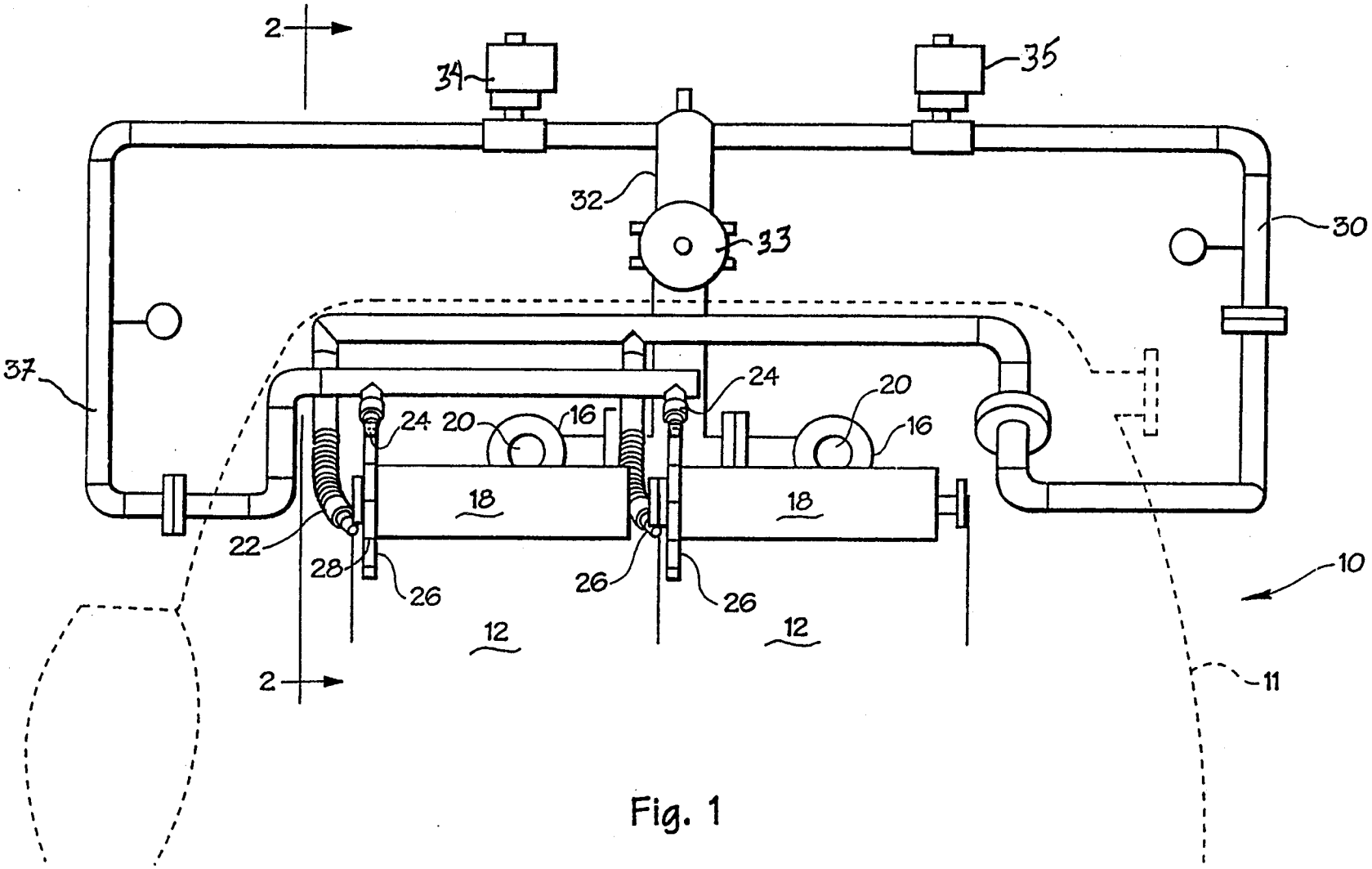
FIG. 1 is an end view in partial cross-section of a jet dyeing machine incorporating the preferred embodiment of the apparatus for driving a lifter reel of the present invention.

Referring now to the drawings and particularly to FIG. 1 a conventional textile wet processing apparatus 10 shown in the form of a jet drying machine is provided for circulating fabric in endless rope form. The apparatus 10 includes a generally circular tank assembly 11, having a treatment chamber 12 containing a treatment liquor bath through which the length of fabric rope F circulates in a plaited plug form. The fabric F is assisted in its movement by lifter reel 18 which is shown in a generally cylindrical form mounted on a shaft for rotation thereabout.

Figure 2:
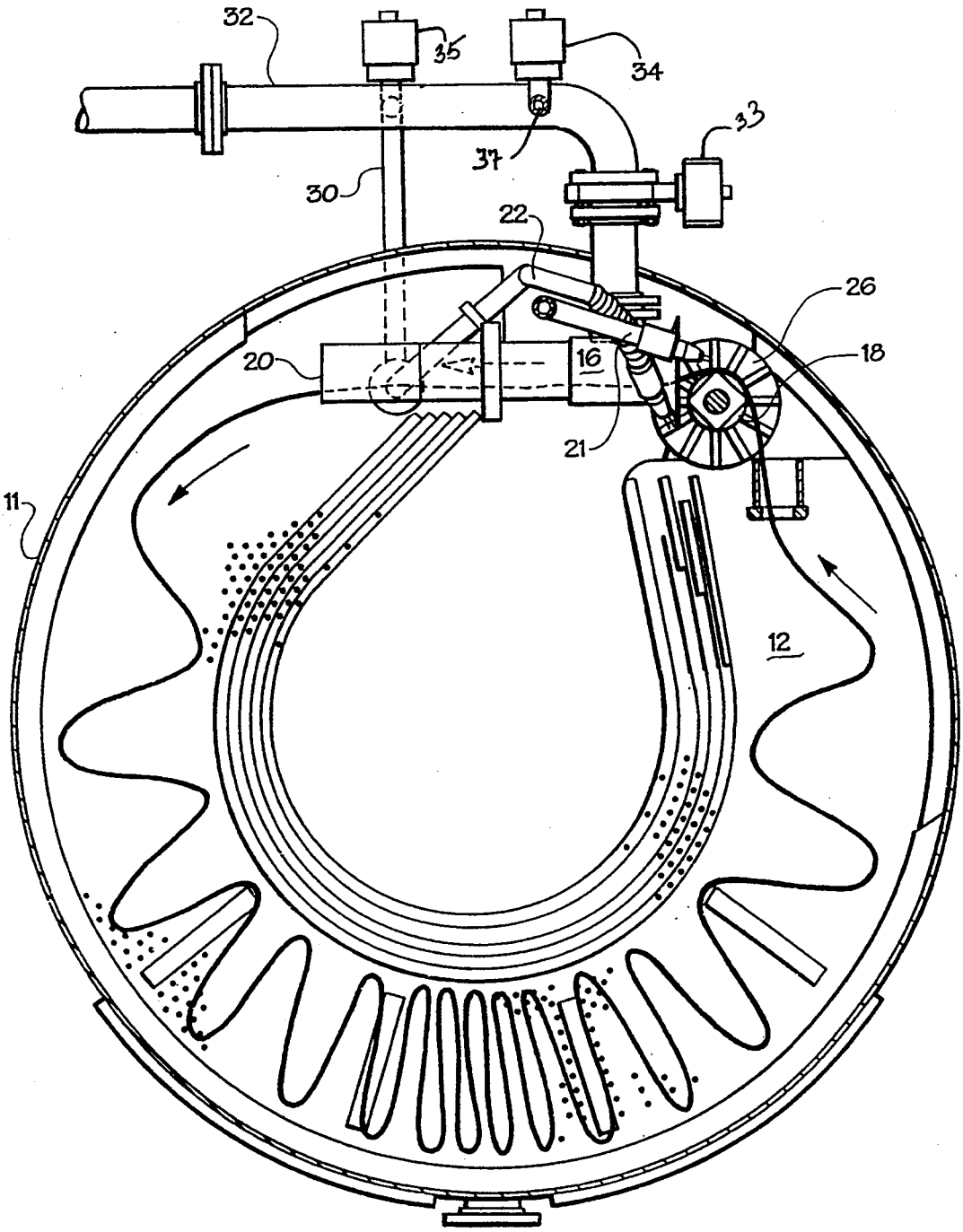
FIG. 2 is an elevation view, in cross-section, taken generally along line 2—2 of FIG. 2.

The motion of liquid flow through the fabric tube 20 may be sufficient to initiate and sustain movement of the fabric F and in such cases the lifter reel rotates freely with the movement of the fabric F, lifts the fabric F above the treating liquor in the treatment chamber 12, and aligns the fabric F with the fabric tube 20. However, the present invention provides for driving the lifter reel in order to assist and control the speed of fabric movement, as previously discussed in the Background. A jet nozzle assembly 16 receives the fabric rope F to be treated from a lifter reel 18 and propels the fabric rope F into the treatment chamber from the fabric tube 20 providing circulation of the fabric rope F through the apparatus 10. As the fabric rope F enters the treatment chamber 12, it is plaited into a folded form known as a plug as seen in FIG. 2. The fabric rope F traverses the treatment chamber in this form.

Figure 3:
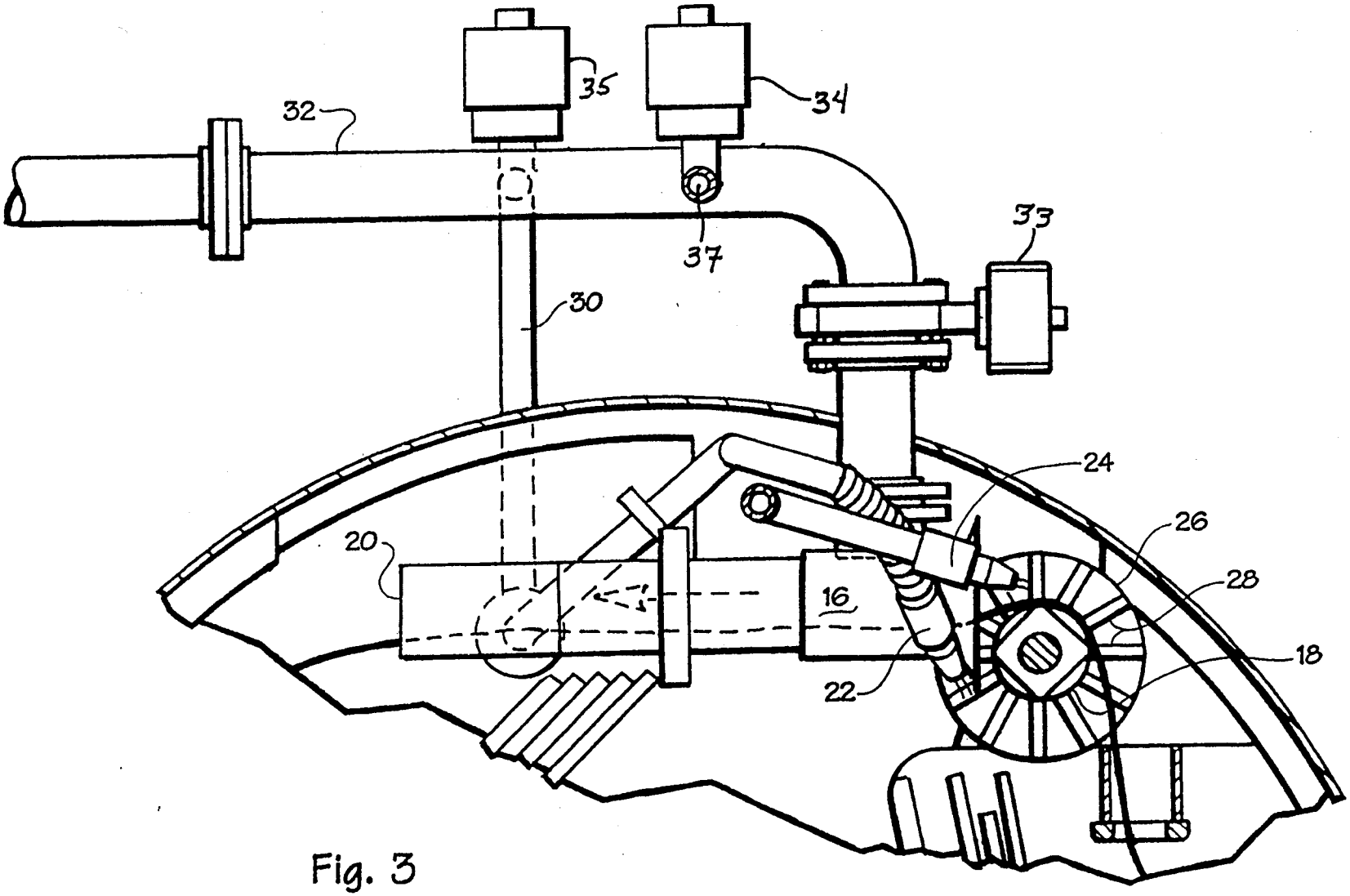
FIG. 3 is a detailed enlarged view of the upper portion of FIG. 2.
Figure 4:
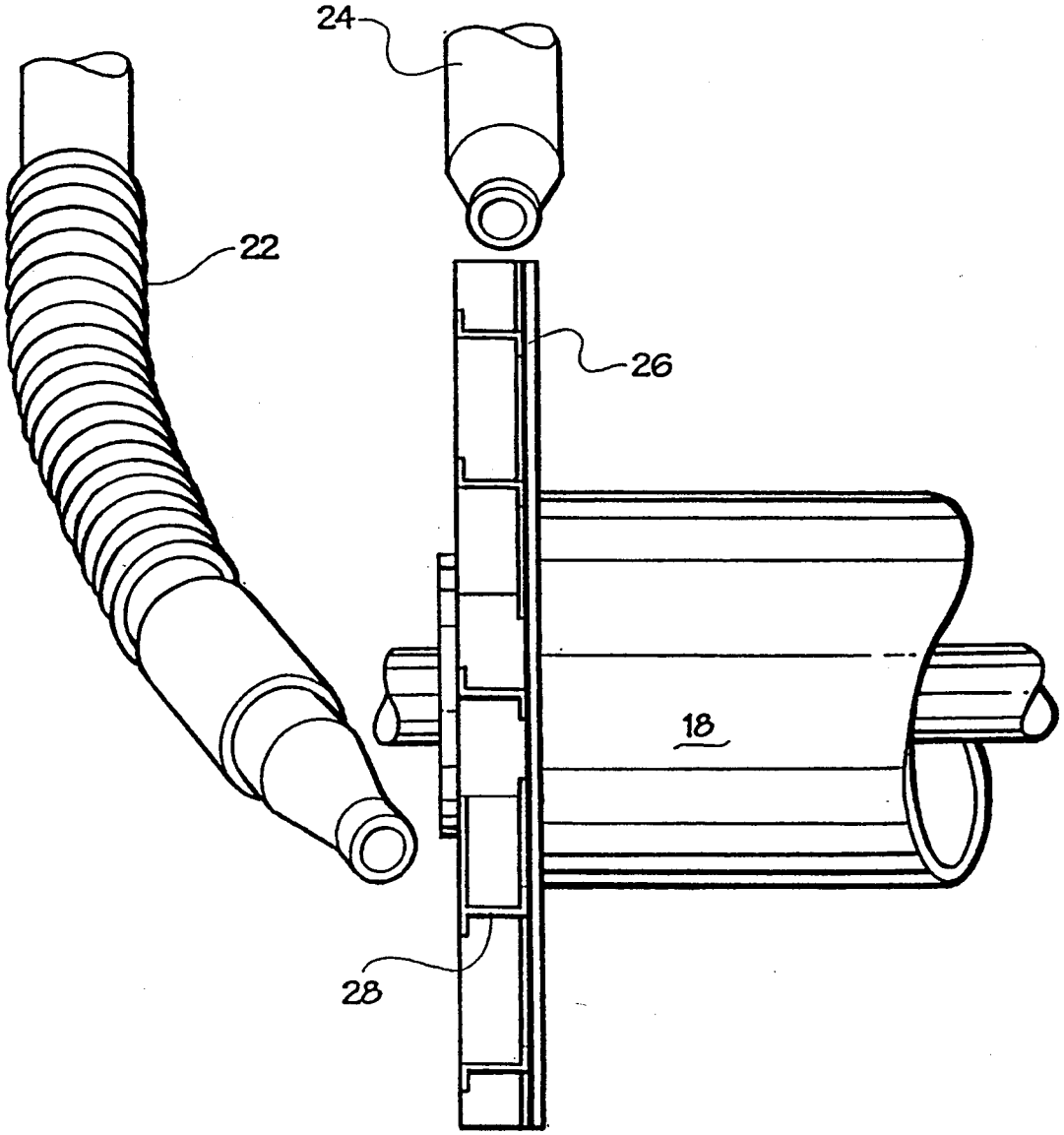
FIG. 4 is a detailed enlarged view of the nozzles, turbine, and lifter reel seen in FIG. 1.

A turbine wheel 26 is affixed co-axially to one end of the lifter reel 18 out of the path of the fabric F traveling over the lifter reel 18. The turbine wheel 26 may have an open side exposing the baffles 28. As best seen in FIG. 4, a forward liquid flow nozzle 22 is disposed at an inclination to the turbine wheel 26 for directing a flow of liquid onto the baffles 28 in a direction to drive the lifter reel 18 in the direction of rope travel to the jet assembly 16 and thereby removing the need for individual electric motors to drive the lifter reels. The liquid flow for the forward liquid nozzle 22 is obtained from a forward liquid flow nozzle manifold 30 which is commonly connected to the main manifold 32. As best seen in FIGS. 2 and 3, operation of the forward flow nozzle 22 requires the closure of reverse nozzle valve 34.

Referring now specifically to FIG. 1, the forward liquid flow manifold 30 is seen to be commonly connected to main manifold 32 providing a source of liquid under pressure to forward liquid flow nozzle 22 which is positioned at the exposed baffles 28 of turbine 26 to result in rotation of the lifter wheel and movement of the fabric rope F. The use of common connections allows for the use of common controls for the nozzles, thereby reducing the costs of the controls while providing compatibility of the drive by the jet and lifter drive.

Figure 5:
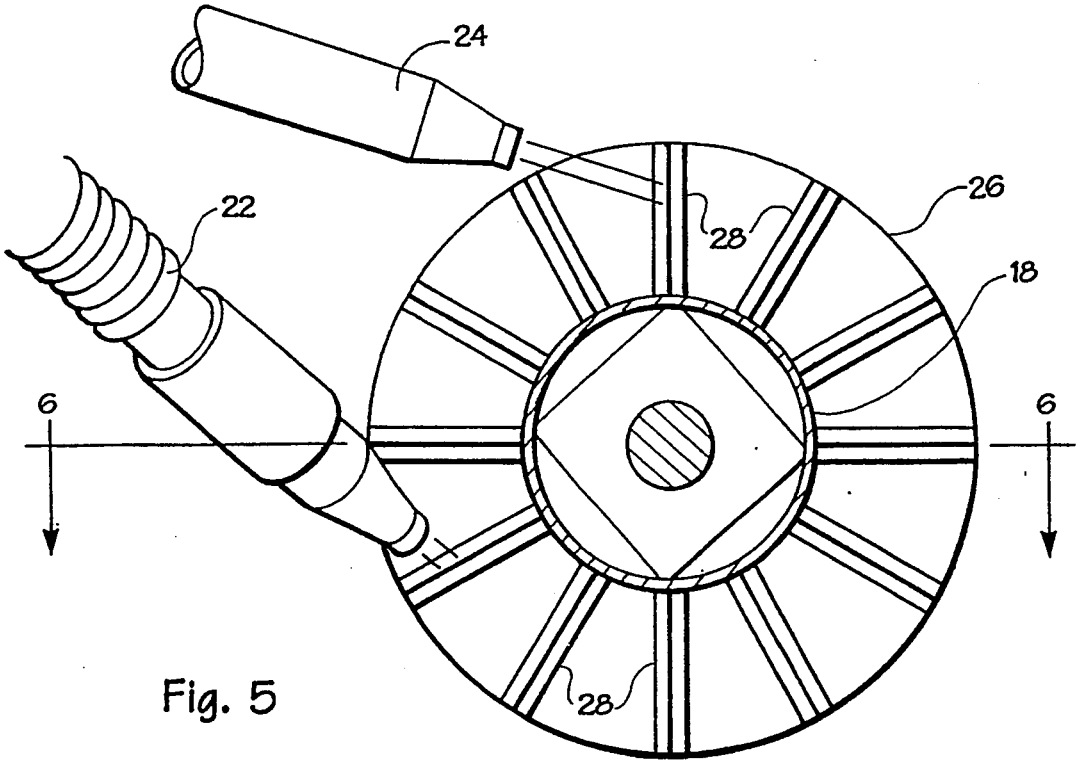
FIG. 5 is a side view of the nozzles and turbine seen in FIG. 4.
Figure 6:
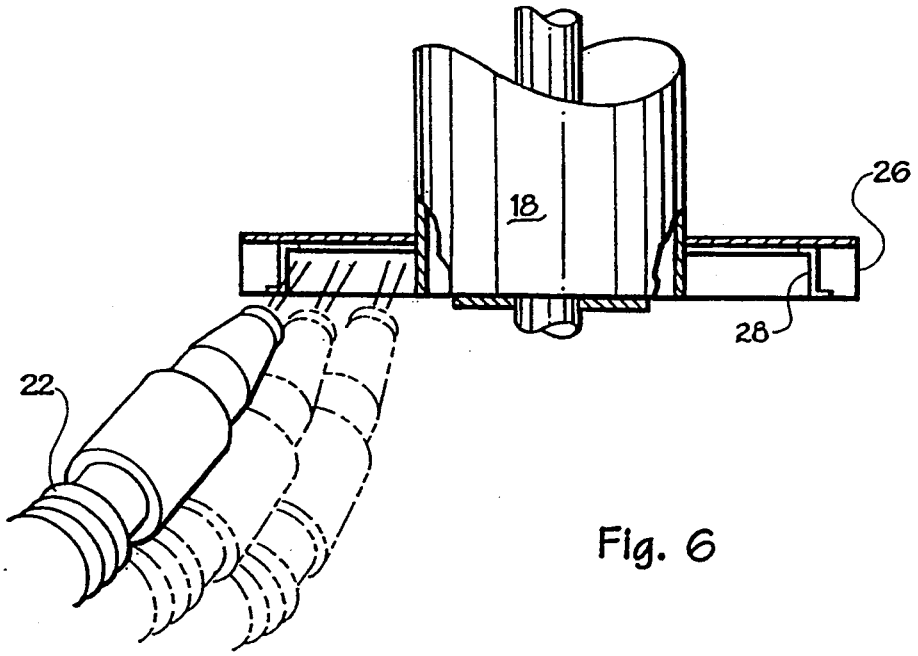
FIG. 6 is a view of tile nozzles, turbine, and lifter reel along line 6—6 of FIG. 6.

As best seen in FIGS. 5 and 6, the forward liquid flow nozzle 22 is adjustable to allow positioning of the forward nozzle so as to direct fluid at a selected lateral inclination to the exposed baffles 28. The nozzle 24 is also adjustable radially with respect to the lifter reel 18 to vary the radial location of the impact of the liquid from the nozzle 22 onto the baffles 28 and thereby vary the driven rate of rotation of the lifter reel 18 and the resulting rate of travel of the rope F. Adjustability can be accomplished by using various devices providing for bending of the forward liquid flow nozzle 22. One such device is corrugated flexible piping. The adjustment of the forward nozzle 22 with use of corrugated piping can thus be seen in FIGS. 4–6. Thus, adjustment of the forward liquid flow nozzle permits drive of the lifter reel 18 to feed the rope F to the jet assembly 16 at a rate compatible with the drive of the rope by the jet assembly 16.

A reverse liquid flow nozzle 24 is included to direct a flow of fluid against the baffles 28 in a direction opposite the rope lifting direction for selectively causing reverse rotation of the lifter reel 18 when it is desirable to relieve any obstructing tangles that may have formed in the fabric rope as it leaves the plug. The reverse nozzle 24 is disposed radially outwardly of the baffles 28 and at a reverse inclination with respect to the direction of rope travel to the jet nozzle assembly 16 for selectively directing liquid to the baffles 28 to cause rotation of the lifter reel 18. The liquid flow for the reverse nozzle 24 may be obtained from a reverse liquid flow manifold 34 which may be commonly connected to the main manifold 32 for a common source of liquid under pressure. Operation of the reverse nozzle 24 requires the closing of forward nozzle valve 35 and main manifold valve 33. Once these valves are closed, flow to the jet nozzle 16 and forward nozzle 22 are stopped and flow to the reverse nozzle 24 can begin upon opening of reverse nozzle valve 34.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An apparatus for driving a lifter reel in a machine for wet processing of fabric in endless rope form having a jet means for directing a flow of liquid,to the fabric rope to cause circulation thereof within the machine, a rotatable lifter reel upstream of said jet means and over which the fabric rope travels to the jet means, said apparatus comprising:

(a) a turbine wheel affixed coaxially to one end of the lifter reel out of the path of the fabric traveling over the lifter reel, said turbine wheel having radially extending baffles; and (b) liquid flow nozzle means for directing a flow of liquid onto the baffles in a direction to drive said lifter reel in the direction of rope travel to said jet means, said liquid flow nozzle means being adjustable to vary the direction of the flow of liquid therefrom in relation to said baffles to thereby vary the driven rate of rotation of said lifter reel.

2. An apparatus for driving a lifter reel according to claim 1 and characterized further in that said turbine wheel has an open side at which said baffles are exposed, and said liquid flow nozzle means includes a nozzle for directing fluid at a lateral inclination to the exposed baffles and being adjustable radially with respect to said lifter reel to vary the radial location of the impact of liquid from the nozzle onto the baffles and thereby vary the driven rate of rotation of said lifter reel and resulting rate of travel of the rope.

3. An apparatus for driving a lifter reel according to claim 2 in that said nozzle means is commonly connected with said jet means to a source of liquid under pressure for use of liquid from the same source by the jet means and the nozzle means, with adjustment of the nozzle permitting drive of the lifter reel to feed the rope to the jet means at a rate compatible with the drive of the rope by the jet means.

4. An apparatus for driving a lifter reel according to claim 2 and characterized further by:

(c) a reverse nozzle means positioned to direct a flow of fluid against said baffles in a direction opposite the rope lifting direction for alternatively causing reverse rotation of the lifter reel, said reverse nozzle means having a nozzle disposed radially outwardly of said baffles and at a reverse inclination with respect to the direction of rope travel to the jet means for selectively directing liquid to the baffles to cause reverse rotation of said lifter reel.

5. An apparatus for driving a lifter reel according to claim 1 and characterized further by:

(c) a reverse nozzle means positioned to direct a flow of fluid against said baffles in a direction opposite the rope lifting direction for alternatively causing reverse rotation of the lifter reel.

6. An apparatus for driving a lifter reel according to claim 5 in that said nozzle means and said reverse nozzle means are commonly connected to a common source of liquid under pressure.

* * * * *